US005130553A

United States Patent [19]

Amoh

[11] Patent Number: 5,130,553

[45] Date of Patent: Jul. 14, 1992

[54] APPARATUS FOR FORMING AESTHETIC ARTIFICIAL NAILS

[75] Inventor: Hiroshi Amoh, Tokyo, Japan

[73] Assignee: Ushio Denki Kabushiki Kaisha, Tokyo, Japan

[21] Appl. No.: 654,271

[22] Filed: Feb. 12, 1991

[30] Foreign Application Priority Data

Sep. 13, 1990 [JP] Japan ..... 2-241232

[51] Int. Cl.[5] ..... G21K 5/08

[52] U.S. Cl. ..... 250/492.1; 250/504 R; 132/73.5

[58] Field of Search ..... 425/174, 174.4; 132/73, 132/73.5; 250/455.1, 492.1, 504 R, 504 H

[56] References Cited

U.S. PATENT DOCUMENTS

| | | | |
|---|---|---|---|
| 4,612,444 | 9/1986 | Ragusa | 250/492.1 |
| 4,718,957 | 1/1988 | Sensenbrenner | 264/227 |
| 4,731,541 | 3/1988 | Shoemaker | 250/455.1 |
| 4,877,963 | 10/1989 | Min-Jenn | 250/504 R |
| 4,896,042 | 1/1990 | Humphreys | 250/455.1 |
| 4,952,812 | 8/1990 | Miripol et al. | 250/492.1 |
| 4,979,523 | 12/1990 | Grimm | 250/492.1 |
| 4,987,310 | 1/1991 | Oppawsky et al. | 250/455.1 |
| 4,988,883 | 1/1991 | Oppawsky | 250/455.1 |

FOREIGN PATENT DOCUMENTS

| | | | |
|---|---|---|---|
| 0201107 | 11/1986 | European Pat. Off. | 132/73 |
| 0303794 | 2/1989 | European Pat. Off. | 132/73 |
| 0352402 | 1/1990 | European Pat. Off. | 132/73 |
| 0356611 | 3/1990 | European Pat. Off. | 132/73 |

*Primary Examiner*—Jay H. Woo
*Assistant Examiner*—Robert B. Davis
*Attorney, Agent, or Firm*—Frishauf, Holtz, Goodman & Woodward

[57] ABSTRACT

Disclosed is an apparatus for forming aesthetic artificial nails by curing a jelly-like visible light-curable resin applied thinly on the fingernails, including: a casing having disposed therein a power circuit containing an inverter circuit, a light source section connected to the power circuit and irradiates visible light, and a slide table on which the finger tips with the fingernails being coated with the jelly-like resin is rested; wherein the light source section is made into a unit consisting of a plurality of small fluorescent lamps, each of which may have a triggering proximate conductor arranged on the same horizontal plane of a substrate in which a card edge terminal to be connected to a card edge connector in the power circuit is integrated and a transparent protector disposed in front of the fluorescent lamps; the slide table being slidably disposed below the light source section so that it can be drawn out of the casing.

6 Claims, 4 Drawing Sheets

APPARATUS FOR FORMING AESTHETIC ARTIFICIAL NAILS

BACKGROUND OF THE INVENTION

This invention relates to an apparatus for forming aesthetic artificial nails on the fingernails.

Makeup by artificial nails is very popular in European countries and U.S.A. More specifically, long plastic artificial nails are bonded with an adhesive on the fingernails and they are coated with a nail enamel. It is also becoming popular to form artificial nails by applying a jelly prepared by mixing a powdery resin with an acrylic solvent onto the fingernails and cured, instead of bonding artificial nails. However, it takes about 20 minutes to naturally cure the jelly-like, gelatinous resin, and besides the acrylic solvent develops strong odor, inconveniently. In order to improve such inconveniences, an ultraviolet-curable resin has come to be used to effect curing thereof by ultraviolet irradiation in a short time of about 2 minutes. Although the last mentioned method is free from the strong odor of acrylic solvent, finger dermatopathy is liable to be caused by the ultraviolet light which is irradiated also onto the finger tip skin, and this method proved not to be an ideal one. While it can be contemplated to use a visible light-curable resin, it requires an apparatus for curing the jelly-like visible light-curable resin applied on the fingernails in a short time by effectively irradiating visible light. Finger tips are particularly sensitive to heat and feel pain if a large amount of heat rays are irradiated thereon from a light source, so that the light irradiated from the light source should have a high spectral emissivity of visible light, and that the apparatus should be able to be handled easily and safely and the light source should be as compact as possible and can irradiate the nail zone effectively.

SUMMARY OF THE INVENTION

Therefore, it is an object of this invention to provide an apparatus for forming artificial nails which can be handled easily and safely and can irradiate visible light effectively so as to cure the jelly-like visible light-curable resin applied on the fingernails in a short time.

The apparatus for forming artificial nails according to this invention comprises a power circuit containing an inverter circuit, a light source section which is connected to the power circuit and emits visible light and a slide table on which finger tips with the fingernails coated with a jelly-like resin are rested, all disposed in a casing; wherein the light source section is made into a unit consisting of a plurality of small fluorescent lamps arranged on the same horizontal plane of a substrate in which a card edge terminal to be connected to a card edge connector in the power circuit is integrated and a transparent protector disposed in front of the fluorescent lamps; the slide table being slidably disposed below the light source section so that it can be drawn out of the casing.

In the apparatus for forming artificial nails having such constitution, since the small fluorescent lamps arranged on the same horizontal plane and operated by a high frequency power source constitute the light source section, not only high electricity/light conversion efficiency and high luminance can be obtained but also visible light can effectively be irradiated with least emission of ultraviolet and heat rays to enable irradiation onto a very limited area including the nail zone and portions adjacent thereto. A transparent protector is disposed in front of the fluorescent lamps to complete the light source section as a unit, so that the fingers can be prevented from touching the lamps directly when they are inserted into or retracted from the apparatus, and that the lamps can also be replaced easily. Moreover, since the slide table is slidably disposed below the light source section and can be drawn out of the casing, the finger tips can be inserted into or retracted from the apparatus by resting the fingertips having the fingernails coated with the jelly-like resin on the slide table and sliding the slide table into or out of the casing. The present apparatus can be used with simple operation, and the finger tips can accurately be positioned below the light source section.

Next, while the fluorescent lamps to be operated by a high frequency power source each have a triggering proximate conductor, connected at one end to one electrode, disposed coaxially along the outer surface of the bulb, the fluorescent lamps can accurately be operated by arranging them in such a way that the electrodes to which the proximate conductors are connected may be in the same direction. It is known that fluorescent lamps naturally emit visible light effectively with lease emission of heat rays, and if a suitable fluorescent material is selected to provide a major radiation wavelength zone of 400 to 600 nm, in other words, if the irradiation dose in said wavelength zone is 80% or more of the total irradiation dose, safety and curing efficiency can further be improved.

DESCRIPTION OF PREFERRED EMBODIMENT

The present apparatus will now be described specifically by way of a preferred embodiment referring to the attached drawings.

Figure 1:
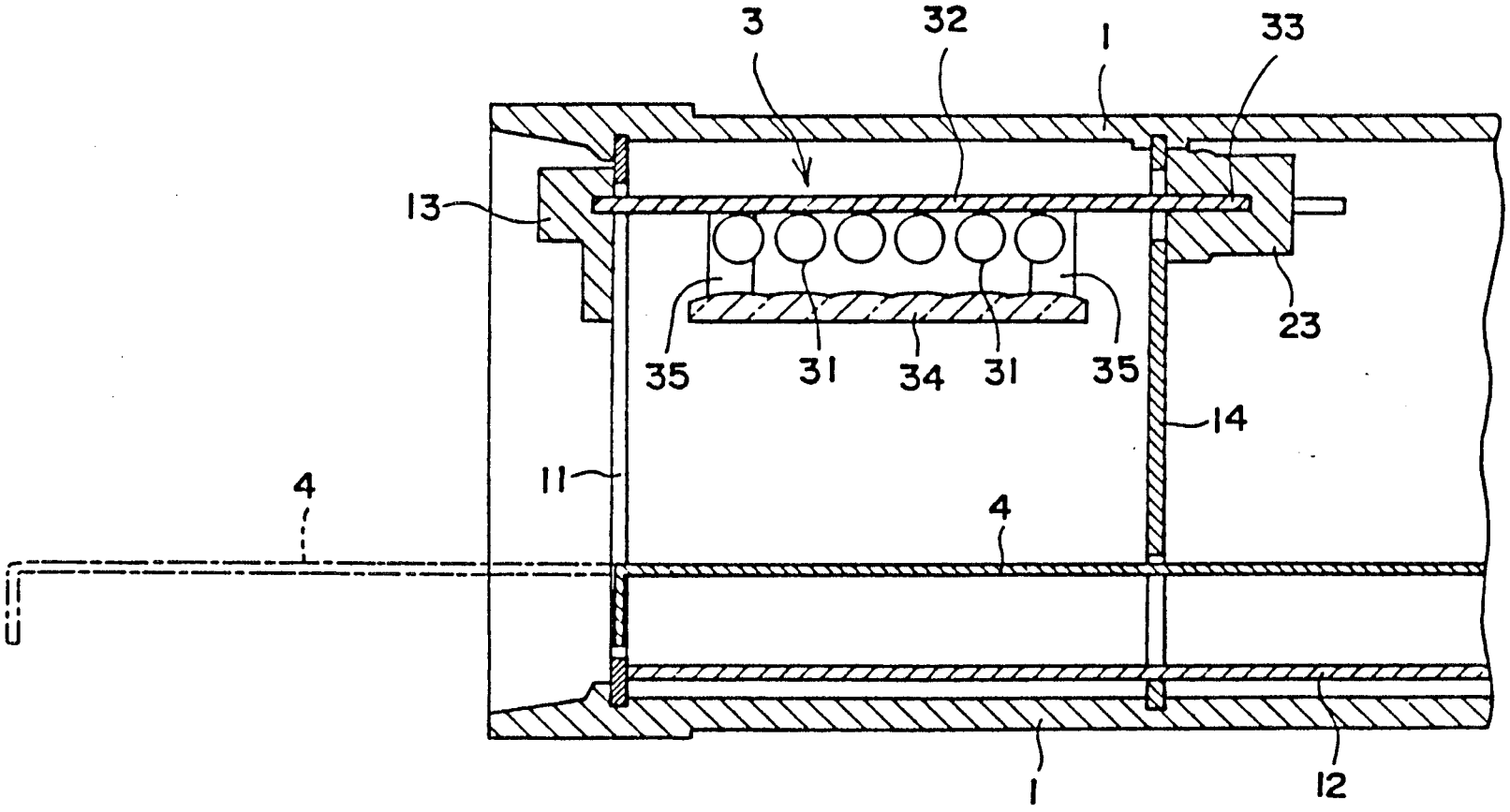
FIG. 1 shows, in cross section, the major section of the apparatus of a preferred embodiment of this invention.

FIG. 1 shows, in cross section, the major section of the apparatus of the preferred embodiment of this invention, wherein an opening 11 is formed at one side of the casing 1, and the inside of the casing 1 is partitioned with a panel 14. A light source section 3 is disposed at the upper left side (in FIG. 1) of the panel 14, and a power circuit (not shown) is disposed on a chassis 12 on the right side (in FIG. 1) of said panel 14. A slide table 4 is disposed slidably relative to the chassis 12 so that it may partly be drawn out of the casing 1 as shown by the dashed line.

Figure 2:
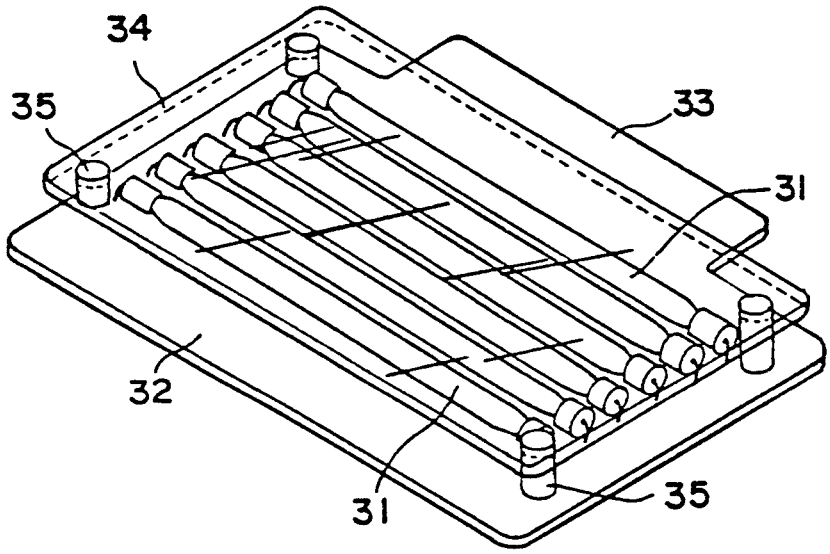
FIG. 2 shows a perspective view of the light source section.
Figure 3:
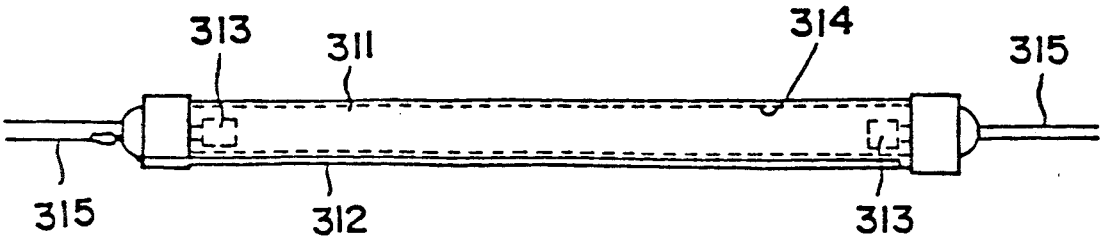
FIG. 3 shows a front view of the fluorescent lamp.

To describe the constitution of the light source section 3 specifically, said unit 3 comprises a printed wiring board 32 having a wiring circuit printed on the upper surface, an aluminum reflector (not shown) laminated on the lower surface of said wiring board and six small fluorescent lamps 31 arranged thereon in parallel. The printed wiring board 32 has at one end a card edge terminal 33 formed to be integral therewith, as shown in FIG. 2, which can be inserted to a card edge connector 23 fixed on the panel 14 to be connected with the power circuit 2. The fluorescent lamps 31 are of compact type as shown in FIG. 3 with a demand of 1.5 W and each has a bulb 311 (outer diameter: 4.1 mm×length: 80 mm) with the internal surface thereof being coated with a three-wavelength fluorescent material 314, A pair of cold-cathode type electrodes 313 are disposed to oppose each other in the bulb 311 at each end, and the electrodes 313 are connected to lead wires 315 extending outward, respectively. A belt-like proximate conductor 312 is axially disposed on the outer surface of each bulb 311, and one end of which is connected to one lead wire 315. A transparent protector 34 in FIG.1 made of a transparent resin is disposed in front of the fluorescent lamps 31 and fixed with pins 35 onto the printed wiring board 32. This protector 34 also acts as a cylindrical compound lens so that it is designed to correct the light as it is transmitted therethrough to be irradiated as parallel rays evenly downward as well as to serve as a protector for the fluorescent lamps 31.

As described above, since the light source section 3 is made into a separable unit, it can be mounted by inserting the card edge terminal 33 into the card edge connector 23 and holding the other end thereof with a holder 13 which is removable from the casing. Accordingly, by removing the holder 13 from the casing 1 the light source section 3 can easily be removed from the apparatus for lamp replacement.

Figure 4:
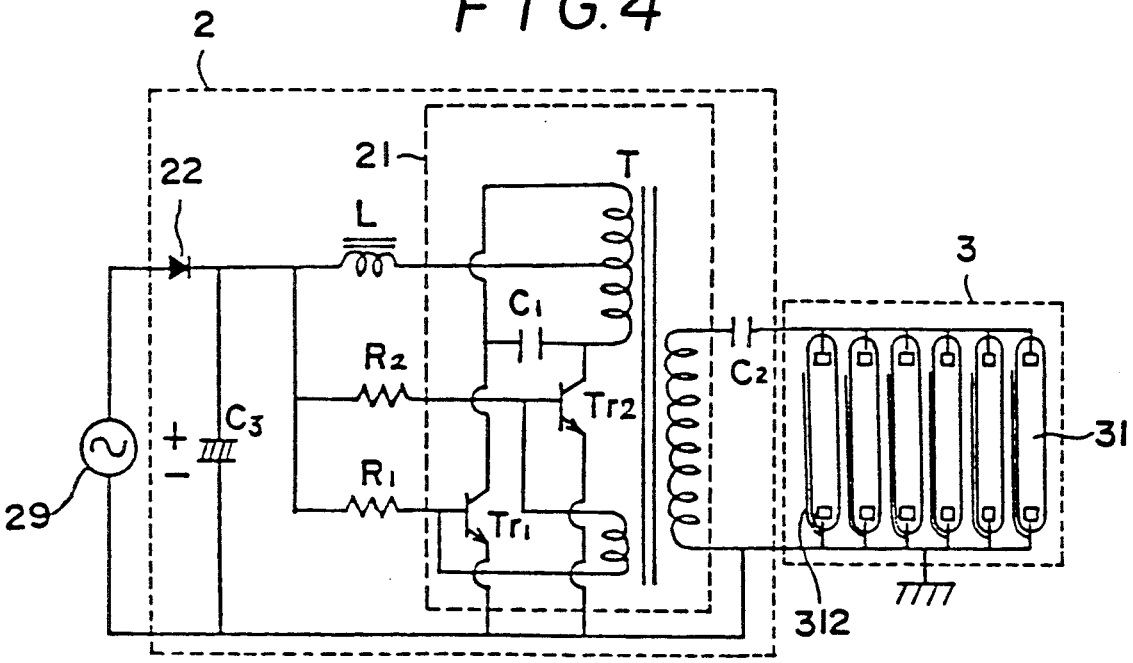
FIG. 4 shows a circuit diagram.
Figure 5:
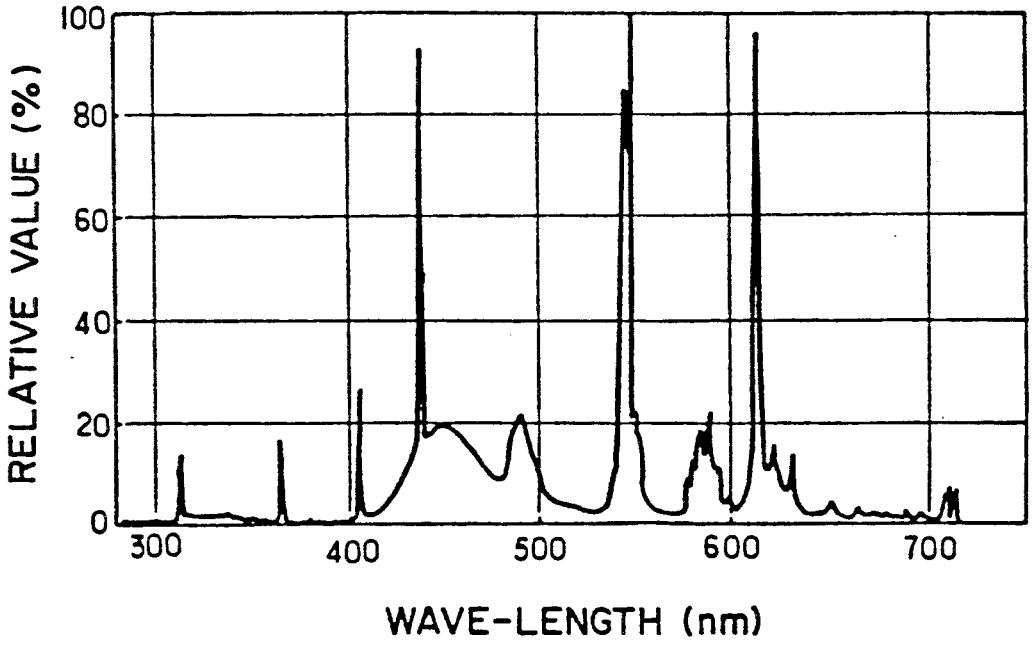
FIG. 5 illustrates a relative spectral distribution.

The fluorescent lamps 31 of the light source section 3 are lit up by the power circuit 2 shown in FIG. 4. The power circuit 2 includes a self-commutated inverter circuit 21 comprising a transformer T, capacitor $C_1$ and a pair of transistors $Tr_1$ and $Tr_2$, and an alternating current from a power source 29 is rectified through an electrolytic capacitor $C_3$ and a diode 22 and inputted to the inverter circuit 21. When the transistor $Tr_1$ is actuated and the transistor $Tr_2$ is deactuated, a high voltage of high frequency electric power is generated in the secondary circuit of the transformer T, and said voltage is applied to the fluorescent lamps 31. The proximate conductors 312 which facilitates lighting of the lamps are all connected to the grounding side lead wires of the respective lamps, and the fluorescent lamps 31 are arranged on the printed wiring board 32 in the same direction. Accordingly, frequency can be determined by suitably selecting the capacity of the capacitor $C_1$ and the reactance of the transformer T in the inverter circuit 21, and the lamps 31 are lit at a high frequency wavelength of about 30 KHz; wherein the lamp current is about 5 mA and the lamp voltage is about 300 V. When the fluorescent lamps 31 are lit with the aid of the power circuit 2, the color temperature of the light irradiated therefrom is about 9000° K.; the luminance, about 16000 nt; and has the relative spectral distribution, as shown in FIG. 5. Namely, the percentage of the irradiated light in the wavelength zone of 400 to 600 nm is 80% or more of the entire irradiated light, which means that visible light is effectively irradiated with the least emission of ultraviolet and heat rays.

Figure 6:
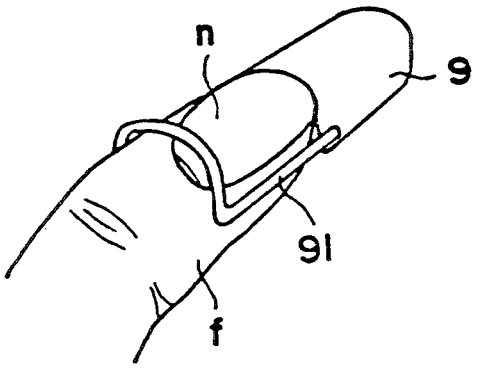
FIGS. 6 (A), 6 (B) and 7 illustrate how to use the apparatus of this invention.
Figure 6:
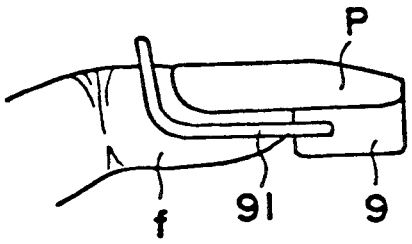

In the way, when an artificial nail is to be formed using the present apparatus, an attachment 9 having a curvature conforming to that of the fingernail n is attached to the finger tip f, as shown in FIG. 6(A). The attachment 9 has a resilient clip 91 so that it can be clipped thereby onto the finger tip f. As shown in FIG. 6(B), a jelly-like visible light-curable resin P is applied onto the fingernail n in such a way that the resin coating may extend over the attachment 9 to form an elongated nail shape.

Figure 7:
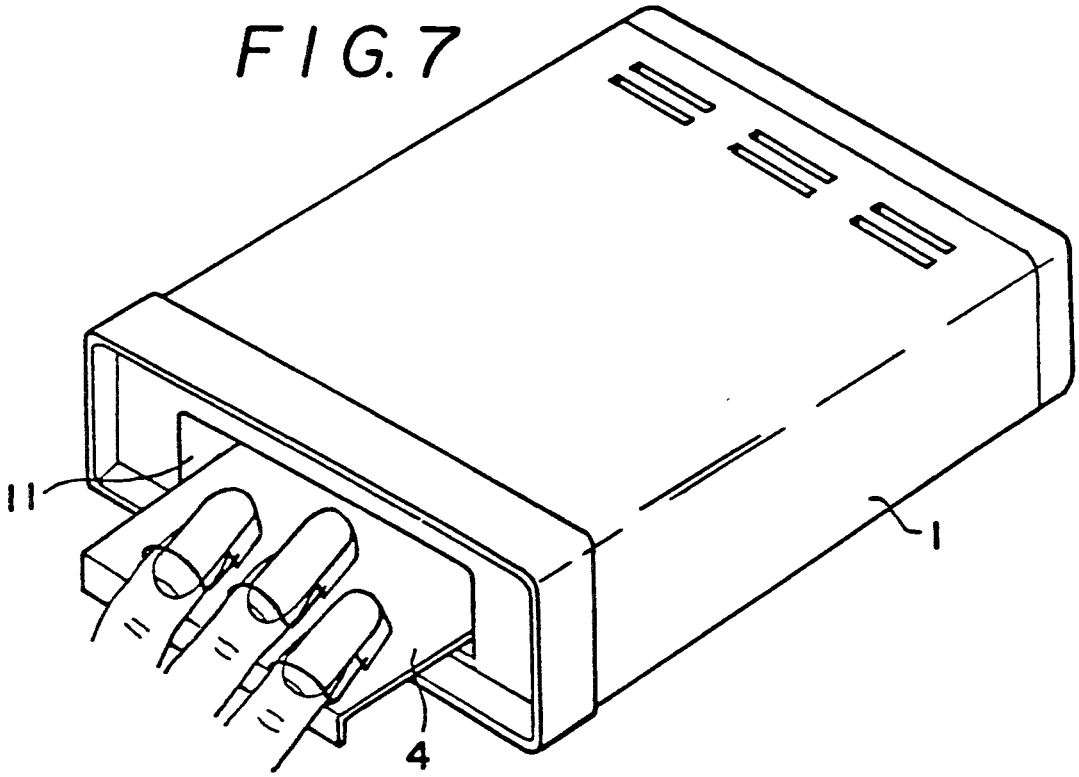

The resin P is, for example, based on a dimethacrylate resin which is used as a base for artificial teeth which has been proved to be a safe material and has a light sensitive wavelength zone of 400 to 600 nm. Next, after the fluorescent lamps 31 are lit up, the slide table 4 is drawn out through the opening 11 of the casing 1, as shown in FIG. 7, and the slide table 4 is slid into the apparatus with the finger tips f being rested thereon, whereby the finger tips f can be positioned accurately below the light source section 3 and visible light is irradiated on the resin P which cures in about two minutes. Now that the resin P is cured, the slide table 4 is drawn out and the attachments 9 are removed, and thus artificial nails can be formed.

As has been described heretofore, since the apparatus for forming artificial nails according to this invention is first of all capable of irradiating visible light effectively onto a limited zone of the finger tips from the light source section in which small fluorescent lamps operated by a high frequency power source are arranged in parallel, curing of the resin can be carried out with high efficiency and safety. Moreover, the unit form of light source facilitates lamp replacement, and insertion or retracting of finger tips is carried out with the aid of the slide table, so that the user can feel ease in operating the apparatus.

What is claimed is:

1. An artificial nail forming apparatus for forming aesthetic artificial fingernails on a person by curing a gelatinous visible light curable resin which is thinly applied to said fingernails, comprising:

a casing:

a power circuit housed in said casing, said power circuit including an inverter circuit and a connector;

a light source section housed in said casing, said light source section being connected to said power circuit for radiating visible light;

a slidable shelf for positioning said fingernails coated with said gelatinous resin thereon in said casing in a position to receive said radiated visible light from said light source, to cure said resin;

said light source section comprising:

a substrate having terminal means thereon for being removably connected to said connector;

a plurality of small fluorescent lamps, arranged in a common horizontal plane, mounted on said substrate; and a transparent protector positioned adjacent said fluorescent lamps between said fluorescent lamps and said slidable shelf for protecting said fluorescent lamps from damage when said fingernails positioned on said slidable shelf, are slid into said casing.

2. The apparatus according to claim 1 wherein each of said fluorescent lamps comprises:

an elongated hollow bulb having first and second open ends, a longitudinal axis, and a bulb surface positioned between said first and second open ends;

first and second end portions for respectively sealing said first and second open ends of said elongated hollow bulb, each of said end portions including an electrode;

a triggering conductor mounted on said bulb surface along said longitudinal axis of said bulb, said triggering conductor being connected to one of said electrodes of one of said first and second end portions for triggering the ignition of said fluorescent lamp; and said electrodes to which said triggering conductors are connected, of adjacent fluorescent lamps being positioned adjacent to each other.

3. The apparatus according to claim 1, wherein at least 80% of the entire radiated light from each fluorescent lamp falls within a wavelength zone of 400 to 600 nm.

4. The apparatus according to claim 1, wherein said transparent protector comprises a cylindrical compound lens which corrects and forms said visible light radiating from said fluorescent lamps into parallel rays of light which fall substantially evenly and substantially uniformly on said fingertips when said fingernails coated with said gelatinous resin thereon are positioned in said casing.

5. The apparatus according to claim 1, wherein said light source section formed as a unit, is detachable from said apparatus as a unit and replaceable as a unit.

6. The apparatus according to claim 1, wherein the color temperature of the light radiated from each fluorescent lamp is approximately 9,000° K. and the light luminance from each fluorescent lamp is about 16,000 nt.

* * * * *